US011371200B2

(12) United States Patent
Fournier

(10) Patent No.: US 11,371,200 B2
(45) Date of Patent: Jun. 28, 2022

(54) DOCK FLOAT SYSTEM

(71) Applicant: Bruce D. Fournier, Miami, FL (US)

(72) Inventor: Bruce D. Fournier, Miami, FL (US)

( * ) Notice: Subject to any disclaimer, the term of this patent is extended or adjusted under 35 U.S.C. 154(b) by 0 days.

(21) Appl. No.: 16/835,502

(22) Filed: Mar. 31, 2020

(65) Prior Publication Data

US 2020/0332487 A1 Oct. 22, 2020

Related U.S. Application Data

(60) Provisional application No. 62/835,762, filed on Apr. 18, 2019.

(51) Int. Cl.

| | |
|---|---|
| ***E02B 3/06*** | (2006.01) |
| ***B63B 35/38*** | (2006.01) |
| ***B63B 5/20*** | (2006.01) |

(52) U.S. Cl.

CPC ..... *E02B 3/064* (2013.01); *B63B 5/20* (2013.01); *B63B 35/38* (2013.01)

(58) Field of Classification Search

CPC ..... B63B 35/00; B63B 35/38; B63B 21/00; B63B 5/00; B63B 5/20; E02B 3/00; E02B 3/064; E02B 3/06

USPC ..... 114/263, 266, 267

See application file for complete search history.

(56) References Cited

U.S. PATENT DOCUMENTS

| | | | | |
|---|---|---|---|---|
| 3,448,709 A * | 6/1969 | Hardwick, Jr. | ..... | E02B 3/064 114/266 |
| 4,715,307 A * | 12/1987 | Thompson | ..... | B63B 5/20 114/267 |
| 8,166,901 B2 * | 5/2012 | Gerst | ..... | B63B 35/38 114/263 |

* cited by examiner

*Primary Examiner* — Lars A Olson

(74) *Attorney, Agent, or Firm* — Anthony D Peppegrini

(57) ABSTRACT

A composite floating dock system comprised of one or more dock float components, with each dock float component having a dock frame and one or more floats attached thereto, with each of the dock float components constructed of fiberglass reinforced plastic into a single monolithic unit, and being ballasted with encased concrete.

20 Claims, 5 Drawing Sheets

DOCK FLOAT SYSTEM

CROSS REFERENCE TO RELATED APPLICATION

This application claims the benefit of provisional application, U.S. Ser. No. 62/835,762, filed Apr. 18, 2019, entitled DOCK FLOAT SYSTEM, by Fournier, Bruce D., which is hereby incorporated by reference.

BACKGROUND OF THE INVENTION

Floating dock systems found in the prior art are typically constructed of wood, concrete, aluminum and/or steel, or plastic.

Wood Docks:

Wood dock floats are manufactured by building a frame that determines the size of the float, adding internal bracing and structure, bolting on floatation tubs to the bottom of the frame, and fastening deck boards onto the top of the frame. Wood floats can be built to any dimensions simply by cutting the lumber to the proper size. Framing varies from single thickness timber or multiple layers of dimensional lumber fastened together. The frame is fabricated by joining 4 individual sides. These sides are joined in the corners using lumber, 4×4 or 6×6, or galvanized steel corner brackets. Both processes involve the use of galvanized fasteners to hold the parts together.

The four sided frame is further strengthened by the addition of stringers running lengthwise through the interior of the frame. The stringers are similar in construction to the frame in that they can be single thickness timber or dimensional lumber or they can be built up by using multiple layers of dimensional lumber fastened together.

Further strengthening is achieved through the addition of diagonal framing, sectional framing between the stringers and the exterior frame or cross bracing on the bottom of the frames.

With a completed frame in place, floatation tubs are added below the main framework. Floatation tubs are generally roto-molded shells filled with expanded polystyrene (EPS), also known as Styrofoam. The tubs are fastened to the bottom of the frame using lag bolts or bolts passing through the wood framing.

Decking is laid across the frame and fastened to the frame. Support for the decking is added by the internal stringers and diagonal framing. Decking is usually attached with decking screws although more refined decking clip on systems are available.

The floats are banded in 2× dimensional lumber to finish the decking to frame interface. Fendering material such as marine rub rail is usually fastened to this finish banding.

Cleats, piling attachment hardware and utility towers are fastened to the finished dock floats using galvanized steel brackets and plates fastened through the framing and or deck with galvanized steel fasteners.

Wood dock floats are fairly inexpensive to fabricate due to the type of equipment and up-front investment required. The manufacturing process resembles household deck construction requiring basic woodworking tools and a workforce skilled at home construction techniques.

The relatively low up-front investment and material cost gives wood dock floats an edge in base line cost of installation. The square foot cost of composite dock floats is about 40% more than that of wood. In addition to the low cost of fabrication wood, by design, weighs less than my composite floats which reduces trucking costs.

However, wood dock floats have a life expectancy of only between ten and twenty years, depending on location. In upscale marinas and clubs wood floats are targeted for replacement after ten years of service due to annual maintenance costs, cosmetics, and structural issues.

Over time and accelerated by frequent stress wood dock floats suffer a loss of rigidity due to fastener hole elongations, wood deterioration, and metal fatigue of fasteners. This results in dock fingers that roll and twist, increase noise generated by the metal hinge pins and piling hoop hardware, deck screws that back out and create a potential point of accident or injury.

Within three to five years wood dock floats will begin to show signs of age and will require some form of maintenance due to rust stains, mildew, loose or damaged decking in addition to any number of cosmetic issues. Wood splits and galvanized coating are not always consistent and adequate. The appearance of dock floats in many facilities is important and as such dock maintenance expense become a fairly large line item early in the serviceable life of wood dock floats.

It is hard to detect structural defect and potential failures in wood prior to a catastrophic event. Wood will fail during conditions of high loads and movement making recovery difficult. Composites generally exhibit cracks ahead of an impending catastrophic failure which allows a facility time to address a potential issue.

Wood dock floats are unique pieces with no two being exactly the same. Assembly onsite can be challenging which adds to the overall cost of installation.

Concrete Docks:

Concrete dock floats utilize an in-mold fabrication process to shape concrete and expanded polystyrene (EPS) into dock floats. In order to give the molded concrete an internal cavity required to provide floatation (EPS), shapes are cast inside the molded concrete. Due to the process dependence on fixed shaped tooling, concrete dock floats are fabricated in specific sizes. The size of these cast sections requires them to be joined together in order to meet the designed length of the dock float. In order to accomplish this concrete dock floats rely on a wood or timber frame generally referred to as a whaler. The whaler is positioned along the top edge of the floats spanning the gaps between individual sections of dock float. The dock floats are fabricated with tubes embedded in the concrete deck of the dock float. Threaded steel rods (tie rods) pass through these cross tubes and through the whalers. The ends of these threaded rods receive a washer and nut which, when tightened, create a clamping action capturing the dock float between the opposing whalers.

Concrete is poured into tooling (molds) that give the cured concrete shapes their designed dimensions. During the molding process blocks of EPS are captured inside the concrete to provide the necessary floatation and whaler tie rod tubes are located in the deck. The concrete shell may, or may not, be reinforced with steel in line with concrete industry standard practices. Any accommodations for utilities or mechanical services are cast into the dock sections.

Docking and piling positioning hardware is attached to the whalers. On larger concrete dock floats piling holes may be cast into the dock float allowing pilings to be driven through the floats to position them.

Concrete has a long service life exceeding thirty years under the right conditions. Concrete does not deteriorate easily and as such will retain its original appearance over time. Concrete dock floats are extremely heavy and thereby create very stable platforms.

However, concrete dock floats are designed to specifications based on anticipated wave action. Concrete is not flexible and the introduction of excessive motion has caused these dock systems to fail, often with catastrophic results caused by broken sections of heavy concrete. The cost per square foot of concrete dock floats is approximately 40% more than composite dock floats. The life expectance is at least equal to concrete, if not longer for composite. Concrete dock floats rely on wood or timber whalers to join the individual sections of dock floats together with galvanized tie rods. As the whalers deteriorate over time allowing the tie rods to loosen and move inside the embedded tubes. The whalers also act as the attachment point for dock cleats and piling location hardware. As the wood softens and fastener holes elongate these critical parts begin to lose their structural integrity. Whalers also collect debris along the dock float edge resulting in deterioration. Individual concrete dock float sections do not float evenly but instead list dramatically to one side or the other. Floatation jigs are used to stabilize the sections on an even keel for assembly onsite. There is additional cost to installing concrete sections when compared to composite parts. Damaged concrete floats should be replaced while damage to composite floats can be repaired and, in most instances, can be repaired in place.

Steel/Aluminum Docks:

Dock floats are available in steel and aluminum. Aluminum dock floats tend to incorporate aluminum in all aspects of the fabrication process. Steel, unless used in commercial applications, tends to be utilized in fabrication of internal structure clad in secondary material for decking and whalers.

Because steel and aluminum dock floats rely on fabricated internal structures to create a framework, it allows the builder flexibility in design and dimensions. Decking can be any manner of material that can be fastened to the internal framework, as can the siding. Both steel and aluminum tend utilize roto-molded tubs for floatation.

Both steel and aluminum rely on welded joints in the fabrication process. The framework is usually set up with the aid of jigs to properly align the individual pieces joined together to create the framework. In steel fabrication the finished framework will require the application of a coating system to protect the steel from rust and corrosion. Coating generally consist of paint systems or galvanizing. Aluminum construction generally relies on marine grade aluminum purchases with an anodized coating. The use of an anodized coating limits secondary finishes to weld lines and raw edges due to a cutting process. Once the framework has been finished roto-molded tubs are fastened to the bottom of the framework to provide the proper floatation. Decking is provided by either wood boards, composite boards, sheet materials fastened to the framework. The sections of dock float are joined together by a number of systems that includes hinged joints, through bolted flanges, rubber isolated through bolts and integral interlocking sections.

However, steel and aluminum corrode rapidly in salt water resulting in shortened service life. When manufactured primary out the base material, both steel and aluminum construction results in sharp corners and edges. Curves and irregular shapes are difficult. Because sections are fabricated individually there are inconsistencies between parts making assembly more time consuming, adding to the cost of installation.

Plastic Docks:

Plastic dock floats generally utilize some form of polyethylene. Plastic dock floats incorporate the deck, frame or tub and floatation into a single part. These parts are generally small in size but are able to be easily joined together to create larger floating shapes.

Plastic dock floats are fabricated utilizing a rotational molding process roto-molding. The process relies on hollow metal molds into which plastic powder or pellets is placed. The metal mold is rotated along multiple axis while the plastic powder or pellets melt. As the plastic melts it sticks to and flows across the interior surface of the metal mold. The mold continues to rotate while the mold is cured and the plastic returns to a solid state. The result is a hollow plastic part the replicates the shape of the metal mold.

However, plastic floats are inherently unstable. They cannot handle imparted loads. Plastic floats rely on expensive equipment to fabricate the float sections making customization or design irregularities costly or prohibitive. Plastic floats have a place in protected waters or lakes but do not match the stability, durability or flexibility of design enjoyed by composite floats.

It is therefore evident that a new style of manufacture is needed to overcome the deficiencies of prior art floating docks. The present invention discloses a composite dock system that does so.

SUMMARY OF THE INVENTION

The present invention discloses a composite dock float system. The dock float system of the present invention utilizes molds to create dock float components utilizing fiberglass reinforced plastic (FRP). The process creates a dock frame that provides both a support structure and floatation. The dock frame is fitted with a fiberglass cap, and uses any material of choice as decking. Additional floats made of FRP are attached to the bottom of the dock frame to provide increased floatation.

Benefits of the present invention include an exceptionally long service life. There is nothing used in the structural fabrication of the dock float components that can corrode when exposed to a marine environment. Unlike concrete docks, fiberglass has the ability to flex and absorb impact from wave action and vessels. The dock frame is a monoque component where all structural components are chemically bonded into a monolithic unit. Structurally, the dock frame is constructed from composite material, utilizing an interior concrete beam for stiffness and weight. The beam is fabricated through the use of a molded, structurally reinforced composite shell. The shell is composed of a structural cap designed to increase longitudinal stiffness. The shell includes structural flanges designed to interface with the side walls to reduce deflection of the side walls associated with loads imparted by contact with boats or waves. The interior concrete beam is reinforced with composite rebar that eliminates rusting that could occur with steel rebar, as well as avoiding the expansion of steel rebar that could weaken the concrete when exposed to moisture. The interior beam sits on centerline and has a low center of gravity, offering ballast and stability.

The monocoque construction of the dock frame, floats, and reinforcement components are fabricated as a single monolithic unit. There are no mechanical fasteners used in the fabrication of key structural components. Composite structures are chemically bonded utilizing Methyl Methacrylate Adhesives (MMA) or other appropriate adhesives. The side walls of the dock frame are reinforced adjacent to the interior beam to improve stiffness and impact resistance. The corners of the dock frame are fabricated with gradually tapered fiberglass reinforcements to aid in load distribution.

Multiple dock float components are connected to each other by elongate connectors. The longer mating surfaces at the point of attachment dramatically reduces twist, deflection, and roll. The tapered fiberglass reinforcements dramatically improve load transfer when compared to industry standard bolt-on extensions.

Floats are fabricated from fiberglass and bonded to the dock frames. This helps stiffen the dock frame and also eliminates the need for fasteners that may be susceptible to corrosion. The floats are molded with angled sides that increase buoyancy as live loads on the dock frame sinks the floats. The fiberglass construction makes the floats impervious to ice damage from drifting or pushed ice flows.

The dock frame has decking flanges fabricated from FRP and bonded to the side walls. The decking flanges support the decking and receive the decking fasteners; unlike wood it doesn't rot and release the decking fasteners. The decking flanges may also support deck cleats used to moor boats to the dock frame. Cleats are able to be through-bolted with fasteners of minimum length, thereby reducing the tendency for the fasteners to deform or crush the wood and become loose.

The composite dock float components can be bolted together. In this configuration there are no hinged joints like wood that create motion and noise. There is no wear on joints; hinges and rods wear poorly where they fit between components. This embodiment adds to rigidity of docks assembled from multiple dock float components. Further adding to their stability, the dock frame and floats have concrete ballast, adding weight in the right places. Floats may be molded with angled sides that increase buoyancy as live loads on the dock frame sinks the floats. The dock frame itself floats, creating a second stage of floatation in the event significant live loads or weather exceed the floatation capacity of the floats. The dock frame can also be flooded in extreme circumstances to lower it in the water to resist wave action or wind (e.g., during a hurricane).

The dock float system of the present invention is repairable in place. Unlike other methods of dock float construction, composite floats can be repaired in place when damaged. Fiberglass repairs equal or exceed original construction physical specifications. Composite floats are consistent in shape due to manufacturing methods enabling whole sections to be fabricated and shipped to the customer as replacement parts.

Unique features of the present invention include the composite interior beam. No prior art dock system is known to use a concrete reinforced composite beam in a structural application in the construction of a dock float. The composite shell of the beam virtually eliminates the deterioration of the inner concrete core due to exposure to salt water, freezing temperatures, or environmental influences. The stiffness of the beam is easily modified through changes to the composite laminate, making weight control more flexible without changing the size of the beam. Monocoque construction of each dock float component comprising the dock float system means that it is essentially a single part that allows for the transfer of varying loads associated with docking a boat. The composite reinforcements can be tailored to the end use of the dock float system and to account for assumed maximum loads. Prior art docks using traditional materials require overbuilding or have usage and loading limitations. The monolithic single part feature of the dock float component of the present invention eliminates fatigue of materials associated with multiple structural parts bolted together. Moreover, the weight of the concrete structural core adds ballast to the composite dock float component, making it very stable. This stability can be designed into the beam size and placement, making the dock float system extremely adaptable.

Other features and advantages of the invention are described below.

DETAILED DESCRIPTION OF INVENTION

Figure 4:
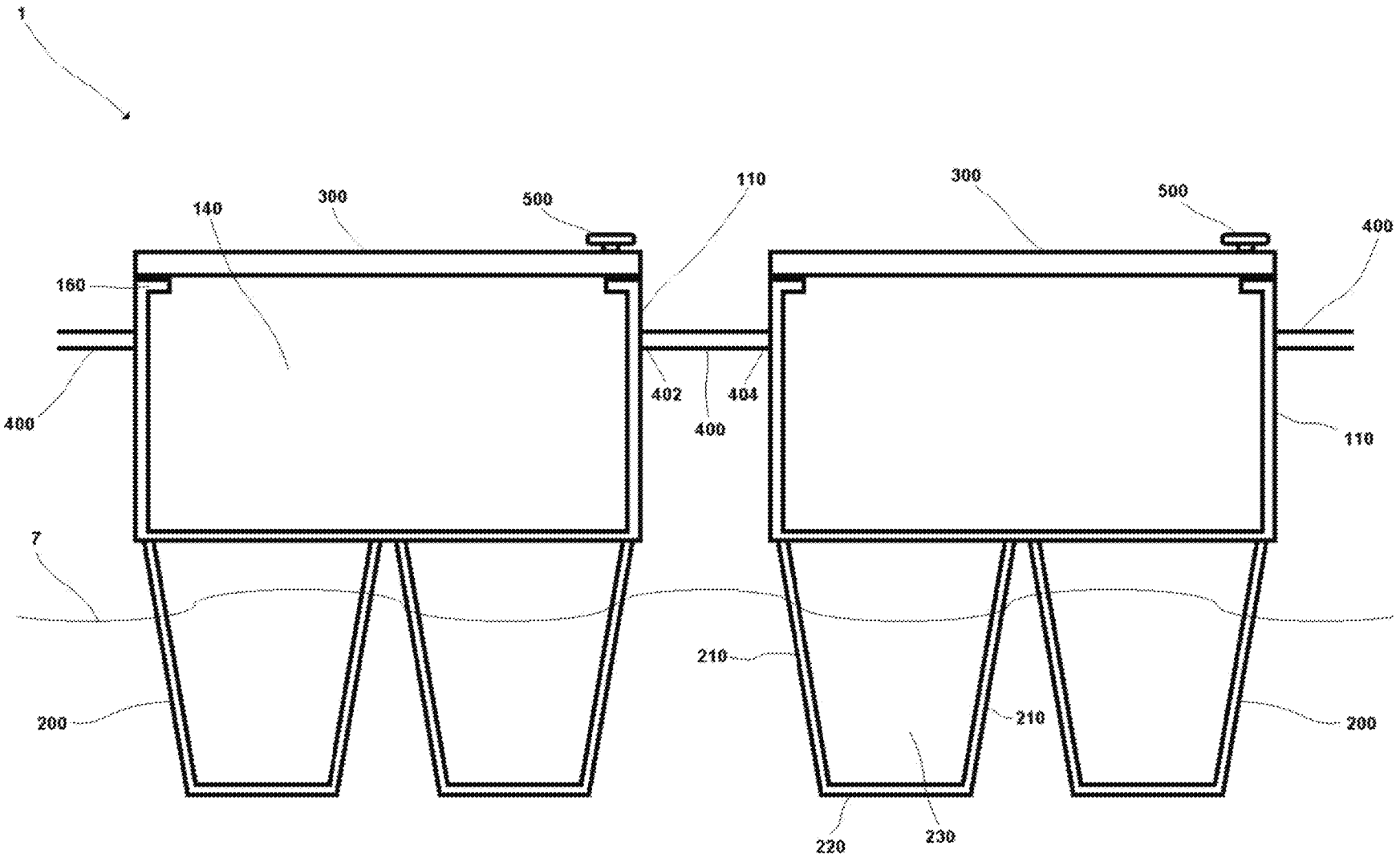
FIG. 4 is a plan side view of a dock float system of the present invention formed by a pair of dock float components linked together by a connector and placed into a water environment.

The present invention is a composite dock float system 1. See FIG. 4. The system is comprised of one or more dock float components 100. Each dock float component 100 is comprised of a dock frame 110 and one or more floats 200. The one or more floats 200 are affixed to the underside 150 of the dock frame 110. The dock frame 110 is topped by decking 300. Multiple dock float components 100 may be attached to each other by connectors 400. The dock float system 1 is intended to be placed into a fresh or salt water environment, whereby the dock float system 1 floats with the dock frame component 110 being entirely or substantially above the water line 7 and the float components 200 being substantially or entirely submerged. See FIG. 4.

The primary novelty of the present invention is how the various components are constructed. Each of the components are constructed of fiberglass reinforced plastic (FRP). Composite rebar may also be employed to provide strength and rigidity to the components. Concrete 5 is also used to provide strength, rigidity, and ballast. The use of these materials make the dock float system 1 much more resistant to environmental degradation, as well as allowing for in place repairs when needed. In addition, greater uniformity of product is ensured.

Figure 1:
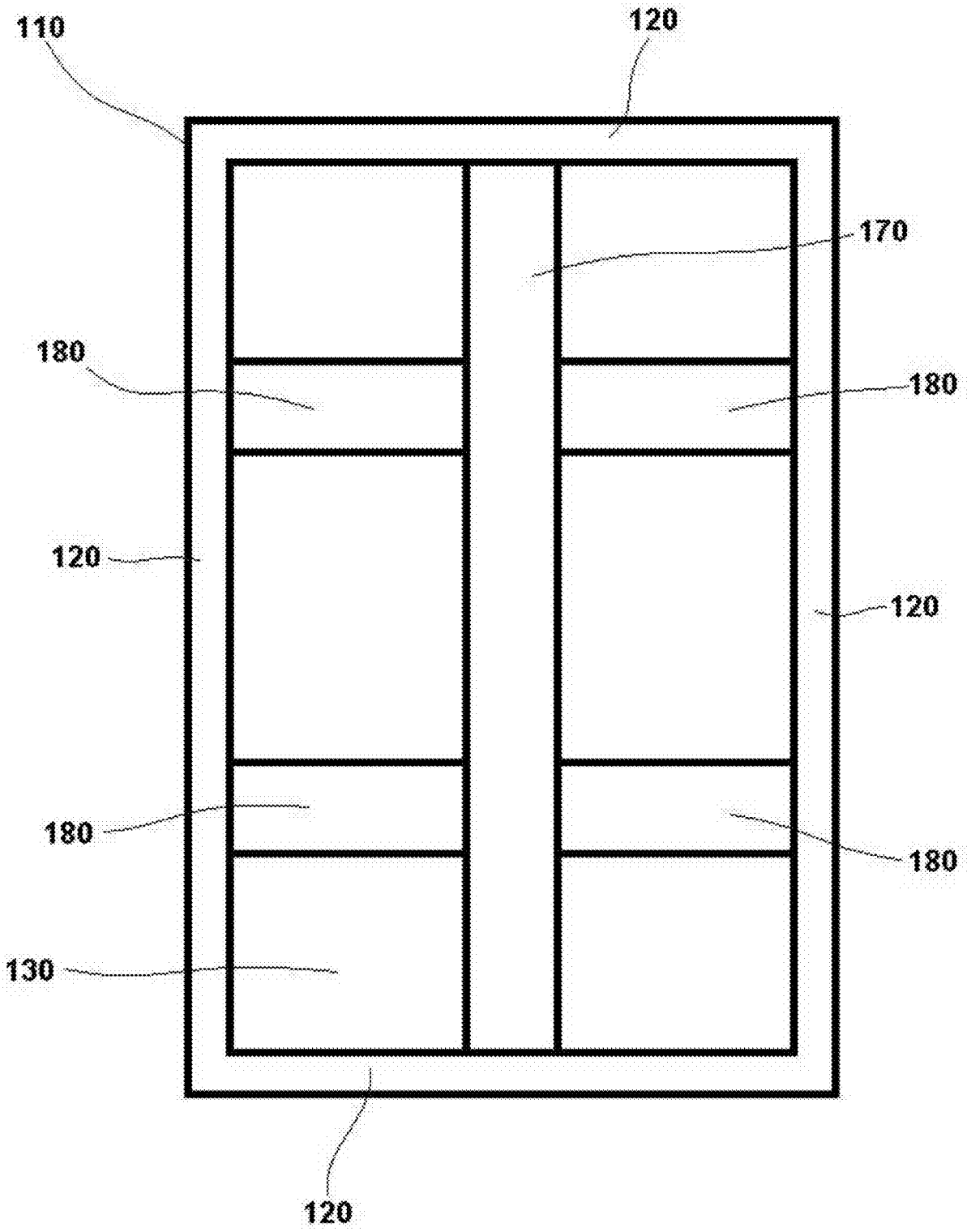
FIG. 1 is a top plan view of the dock frame of the present invention, showing the relation of the side walls to each other, the placement of the central beam within the interior space of the dock frame, and the relation of the multiple cross beams to the central beam and the side walls.

Regarding the components of the dock float system 1, the dock frame 110 is a substantially rectangular structure having four substantially rectangular side walls 120 and a substantially rectangular floor 130, with an open top and an interior space 140. See FIG. 1. One pair of side walls 120 are oriented substantially parallel to each other, and the other pair of side walls 120 are oriented substantially parallel to each other. Adjacent side walls 120 are oriented substantially perpendicular to each other. All four of the side walls 120 are adjacent to and oriented substantially perpendicular to the floor 130. The four side walls 120 and the floor 130 are formed as a monolithic unit, with water tight seams at all points of adjacency of the side walls 120 and floor 130.

Figure 2:
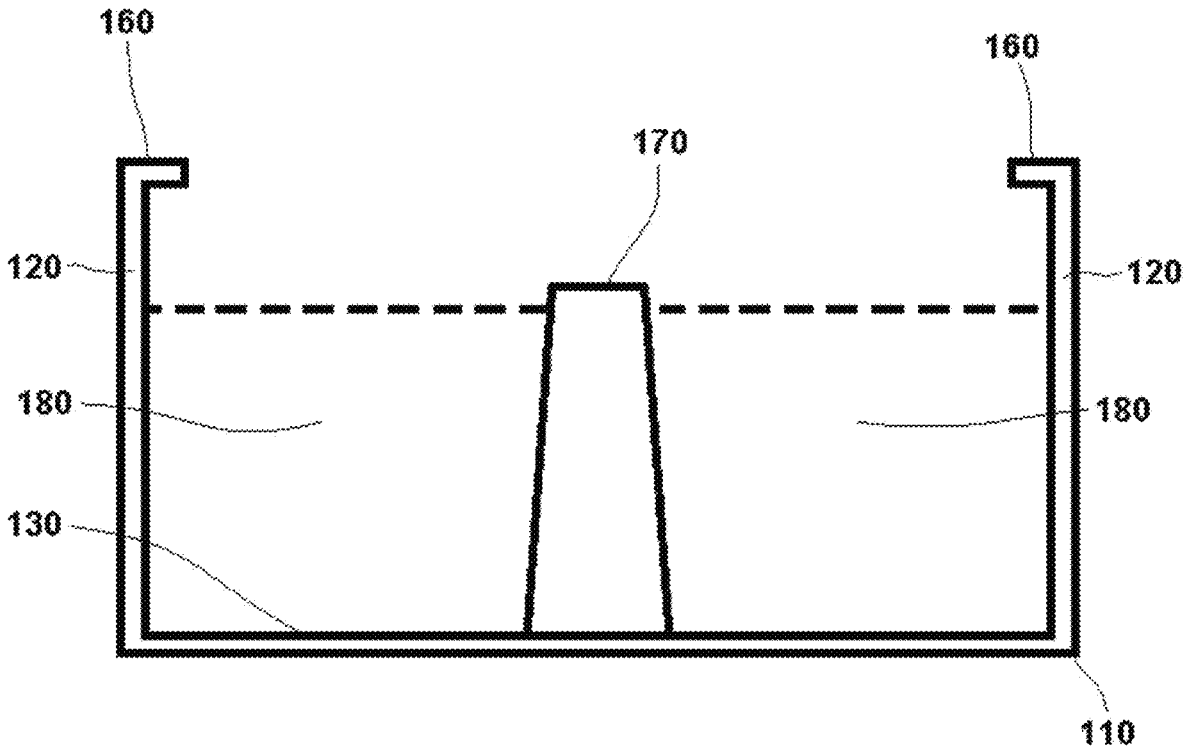
FIG. 2 is a side plan view of the dock frame of the present invention, with one side wall cutaway to reveal the central beam and a pair of cross beams.

Located within the interior space 140 of the dock frame 110 is a central beam 170. See FIGS. 1 and 2. The central beam 170 is adjacent to the floor 130 and rises upward from the floor 130 in a substantially perpendicular orientation to the floor 130. The central beam 170 runs between and is adjacent to one pair of side walls 120, and is oriented substantially perpendicular to those side walls 120. The central beam 170 is spaced apart from the other pair of side walls 120, and is oriented substantially parallel to those side walls 120. Where the central beam 170 is adjacent to a side wall 120, that side wall 120 may be reinforced at the point of adjacency.

The central beam 170 has two substantially rectangular side walls 172 spaced apart from each other, forming a hollow void therebetween. The side walls 172 of the central beam 170 may be oriented substantially parallel to each other, or they may be angled slightly towards each other, such the that portions of the side walls 172 of the central beam 170 adjacent to the floor 130 are farther apart than the portions of the side walls 172 of the central beam 170 furthest from the floor 130. The side walls 172 of the central beam 170 are constructed of the same FRP material as the side walls 120 and floor 130 of the dock frame 110, and may be integrated therewith as a single monolithic structure.

Alternatively, the central beam 170 may be constructed independently of the side walls 120 and floor 130 of the dock frame 110, and then placed into the dock frame 110 and affixed thereto. In this embodiment, the central beam 170 will also comprise a floor, a front wall, and a rear wall. The floor of the central beam 170 will be oriented horizontally and substantially perpendicular to the side walls 172 of the central beam 170 and will run between the bottom edges of the side walls 172 of the central beam 170 and be affixed thereto. The front wall of the central beam 170 will be located at one end of the central beam 170 and oriented vertically and substantially perpendicular to the side walls 172 of the central beam 170 and substantially perpendicular to the floor of the central beam 170 and will run between the front edges of the side walls 172 of the central beam 170 and be affixed thereto and to the front edge of the floor. The rear wall of the central beam 170 will be located at the opposite end of the central beam 170 and oriented vertically and substantially perpendicular to the side walls 172 of the central beam 170 and substantially perpendicular to the floor of the central beam 170 and will run between the rear edges of the side walls 172 of the central beam 170 and be affixed thereto and to the rear edge of the floor. The length of the floor of the central beam 170 will be substantially the same as the lengths of the side walls 172 of the central beam 170 and the heights of the front and rear walls of the central beam 170 will be substantially the same as the heights of the side walls 172 of the central beam 170. The side walls 172 of the central beam 170 in this embodiment may be oriented substantially parallel to each other, or they may be angled slightly towards each other, such the that portions of the side walls 172 of the central beam 170 adjacent to the floor of the central beam 170 are farther apart than the portions of the side walls 172 of the central beam 170 furthest from the floor of the central beam 170. The front wall of the central beam 170 is substantially parallel to the rear wall of the central beam 170. The side walls 172, front wall, rear wall, and floor of the central beam 170 in this embodiment are constructed of the same FRP material as the side walls 120 and floor 130 of the dock frame 110, and may be integrated with each other as a single monolithic structure. So configured, the central beam 170 will comprise four sides, a floor, and an open top.

Figure 3:
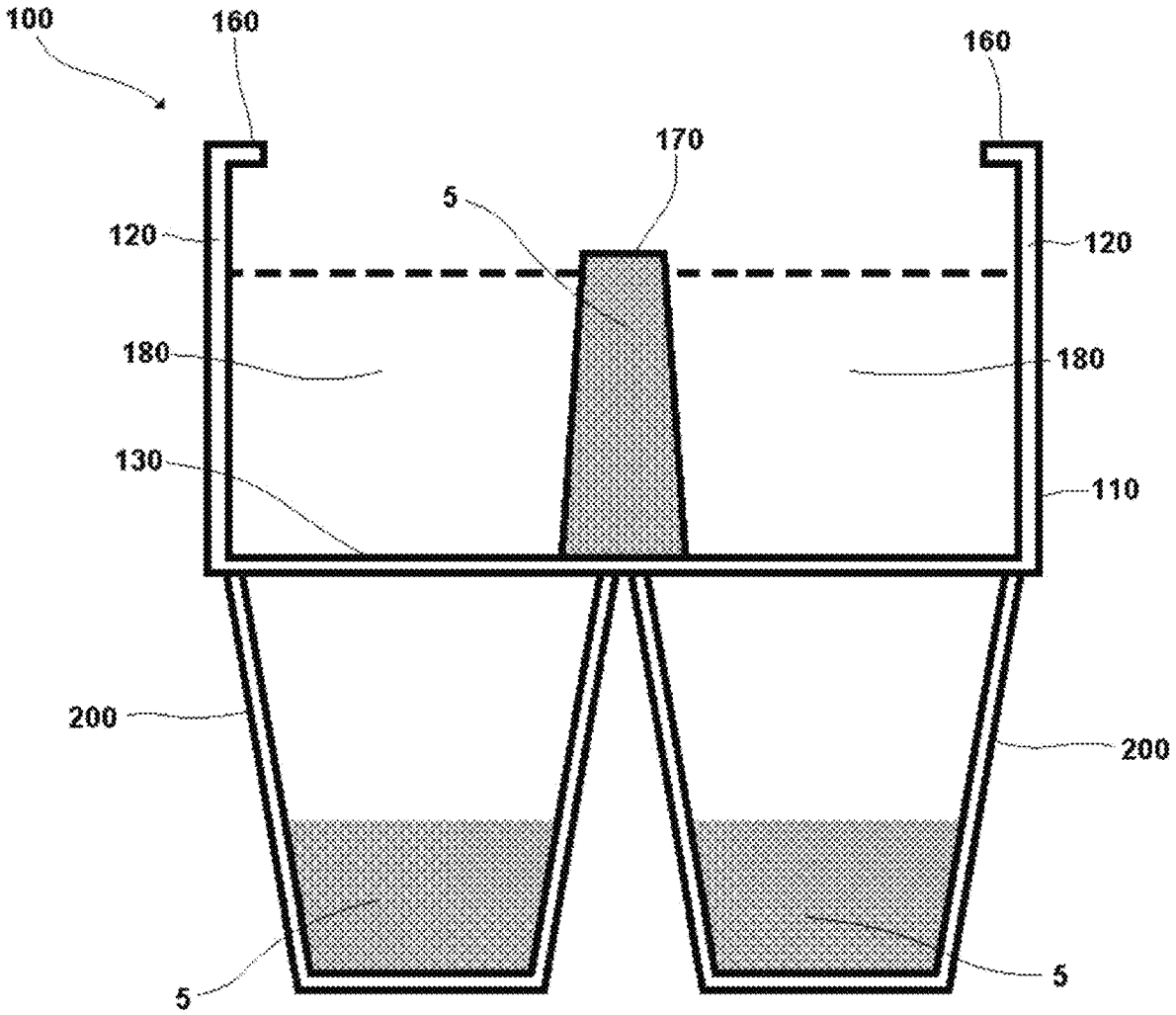
FIG. 3 is a side plan view of the dock frame of the present invention with attached floats, with one side wall of the dock frame cutaway to reveal the central beam filled with concrete and a pair of cross beams, and with one side wall of each float cutaway to reveal the concrete ballast located within the interiors of the floats.
Figure 5:
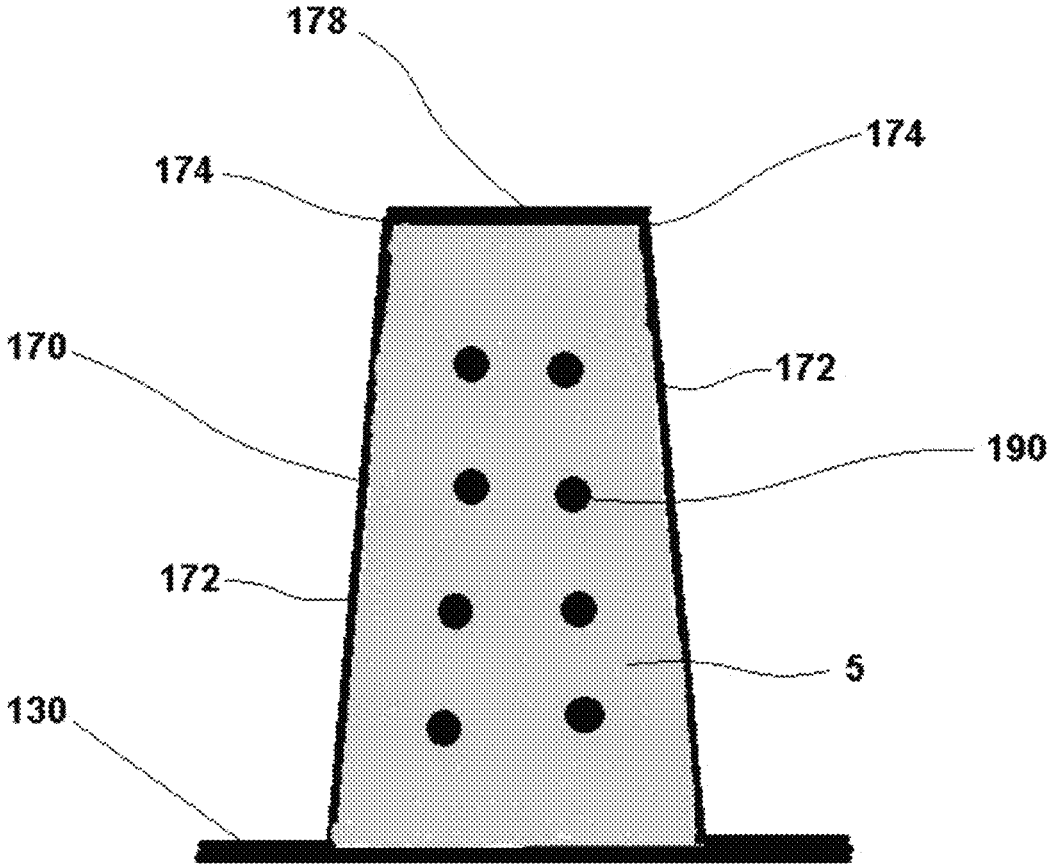
FIG. 5 is a plan side cutaway view of the central beam of the dock frame of the present invention showing the concrete filling as well as the composite rebar placed within the concrete for added strength.

Concrete 5 is placed within the hollow void of the central beam 170, in either of the above-described embodiments of the central beam 170. See FIGS. 3 and 5. Horizontally oriented reinforcement components 190 may be placed in the concrete 5 that is placed within the hollow void of the central beam 170. See FIG. 5. These reinforcement components 190 may be composite rebar. The central beam 170 may have a reinforced composite cap 178 placed onto the top edges 174 of its side walls 172, thereby sealing its interior space. The cap 178 may be constructed of the same FRP material as the side walls 172 of the central beam 170. The cap 178 may be substantially planar and oriented substantially parallel to the floor 130 of the dock frame 110 (or the floor of the central beam 170 in the alternate embodiment). Preferably, the height of the central beam 170 should be not greater than the height of the side walls 120 of the dock frame 110.

Also located within the interior space 140 of the dock frame 110 may be one or more cross beams 180. See FIGS. 1 and 2. Each cross beam 180 is adjacent to the floor 130 and rises upward from the floor 130 in a substantially perpendicular orientation to the floor 130. Each cross beam 180 runs between and is adjacent to a side wall of the dock frame 110 and the central beam 170, and is oriented substantially perpendicular to that side wall and the central beam 170. Where each cross beam 180 is adjacent to a side wall, that side wall may be reinforced at the point of adjacency. A pair of cross beams 180 may be positioned in alignment with each other, one on either side of the central beam 170.

Each cross beam 180 has two substantially rectangular side walls spaced apart from each other, forming a hollow void therebetween. The side walls of each cross beam 180 may be oriented substantially parallel to each other, or they may be angled slightly towards each other, such the that portions of the side walls of said cross beam 180 adjacent to the floor 130 are farther apart than the portions of the side walls of said cross beam 180 furthest from the floor 130. The side walls of each cross beam 180 are constructed of the same FRP material as the side walls 120 and floor 130 of the dock frame 110, and may be integrated therewith as a single monolithic structure. Concrete 5 may be placed within the hollow void of each cross beam 180. Horizontally oriented reinforcement components 190 may be placed in the concrete 5 that is placed within the hollow void of each cross beam 180. These reinforcement components 190 may be composite rebar. Each cross beam 180 may have a reinforced composite cap placed onto the top edges if its side walls, thereby sealing its interior space. The cap may be constructed of the same FRP material as the side walls of the cross beam 180. The cap may be substantially planar and oriented substantially parallel to the floor 130 of the dock frame 110. The height of each cross beam 180 should be not greater than the height of the side walls 120 of the dock frame 110, and preferably should be substantially the same as the height of the central beam 170.

In an alternative embodiment, each cross beam 180 may be constructed independently of the side walls 120 and floor 130 of the dock frame 110, and then placed into the dock frame 110 and affixed thereto. In this embodiment, each central beam 170 will also comprise a floor, a front wall, and a rear wall, with these elements being constructed in the same way as the corresponding elements of the central beam 170 in the alternate embodiment.

Formed along the top edges of at least a pair of the side walls 120 of the dock frame 110 are deck flanges 160. See FIGS. 2 and 3. Each deck flange 160 is substantially planar and is oriented substantially parallel to the floor 130 of the dock frame 110 and extends partially over the interior space 140 of the dock frame 110. The deck flanges 160 are constructed of the same FRP material as the side walls 120 and floor 130 of the dock frame 110, and may be integrated therewith as a single monolithic structure.

Decking 300 is provided to fit over the open top of the dock frame 110. See FIG. 4. The decking 300 is oriented substantially parallel to the floor 130 of the dock frame 110. The decking 300 is attached to the deck flanges 160. Cleats 500 may be affixed to the decking 300. Any appropriate material may be used for the decking 300. This includes wood, fiberglass, composite material, and the like. The decking 300 (or portions thereof) may be removably attached to the dock frame 110 to allow access to the interior space 140 of the dock frame 110.

One or more floats 200 are associated with the dock frame 110. See FIGS. 3 and 4. Each float 200 is a substantially rectangular structure having four substantially rectangular side walls 210, a substantially rectangular floor 220, and a substantially rectangular top, enclosing an interior space 230. One pair of side walls 210 are oriented substantially parallel to each other, and the other pair of side walls 210 are oriented substantially parallel to each other. Adjacent side walls 210 are oriented substantially perpendicular to each other. All four of the side walls 210 are adjacent to and oriented substantially perpendicular to the floor 220. The top is adjacent to and oriented substantially perpendicular to the four side walls 210 and substantially parallel to the floor 220. The four side walls 210, the floor 220, and the top of the float 200 are constructed of the same FRP material as the side walls 120 and floor 130 of the dock frame 110 and may be formed as a monolithic unit, with water tight seams at all points of adjacency of the side walls 210, the floor 220, and the top.

In an alternative embodiment, one pair of side walls 210 of the float 200 are angled slightly towards each other, such the that portions of these side walls 210 adjacent to the floor 220 of the float 200 are farther apart from each other than the portions of these side walls 210 adjacent to the top of the float 200. In this embodiment these side walls 210 are oriented at an angle to the floor 220 and to the top of the float 200. The other pair of side walls 210 are trapezoidal in shape.

In yet another alternative embodiment, both pairs of opposing side walls 210 of the float 200 are angled slightly towards each other, such the that portions of these side walls 210 adjacent to the floor 220 of the float 200 are farther apart from each other than the portions of these side walls 210 adjacent to the top of the float 200. In this embodiment all of these side walls 210 are oriented at an angle to the floor 220 and to the top of the float 200, and each of these side walls 210 is trapezoidal in shape.

Located within the interior space 230 of each float 200 is a quantity of concrete 5. See FIG. 3. The quantity of concrete 5 located within each float 200 should be substantially the same as the quantity of concrete 5 located within each other float 200.

Each of the one or more floats 200 associated with a dock frame 110 is affixed to the dock frame 110 by affixing the top surface of the top of the float 200 to the bottom surface 150 of the dock frame floor 130.

When the dock float system 1 is comprised of a plurality of dock float components 100, each dock float component 100 comprises one or more elongate connectors 400. See FIG. 4. The connectors 400 extend from the side walls 120 of the dock frames 110 of the dock float components 100, such that connectors 400 from different dock float components 100 may be attached to each other. The connectors 400 may attach to each other in a rigid configuration, whereby connected dock float components 100 move in sync relative to each other, or in a flexible configuration, whereby connected dock float components 100 may move independently relative to each other.

In one embodiment, the first end 402 of a connector 400 is attached to a side wall 120 of a dock frame 110, and the second end 404 of that connector 400 is attached to a side wall 120 of another dock frame 110. See FIG. 4. In another embodiment, the first end 402 of a connector 400 is attached to a side wall 120 of a dock frame 110, and the second end 404 of that connector 400 is attached to the second end 404 of another connector 400 attached to the side wall 120 of another dock frame 110.

What has been described and illustrated herein are preferred embodiments of the dock float system 1 of the present invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Other embodiments not specifically set forth herein are also contemplated.

I claim:

1. A dock float system, said system comprising one or more dock float components, each said dock float component comprised of a dock frame and one or more floats, with each of the one or more floats affixed to an underside of said dock frame;

wherein said dock frame is constructed of fiberglass reinforced plastic and incorporates concrete therein, said dock frame is substantially rectangular, having four substantially rectangular side walls and a substantially rectangular floor, with an open top and an interior space, wherein two of the side walls comprising a first pair of side walls are oriented substantially parallel to each other, and two other side walls comprising a second pair of side walls are oriented substantially parallel to each other, with each side wall of the first pair of side walls adjacent to both side walls of the second pair of side walls, with adjacent side walls oriented substantially perpendicular to each other, and all four side walls adjacent to and oriented substantially perpendicular to the floor, such that the four side walls and the floor are formed as a monolithic unit, with water tight seams at all points of adjacency of the side walls and floor, and each of said one or more floats is constructed of fiberglass reinforced plastic and incorporates concrete therein;

whereby said dock float system is placed into a water environment such that said dock float system floats with each dock frame being substantially above the water and the one or more floats being substantially submerged.

2. The dock float system of claim 1 wherein the dock frame of each of the one or more dock float components is topped by decking.

3. The dock float system of claim 1 wherein the dock frame of each of the one or more dock float components further comprises a pair of deck flanges, with a first deck flange located on an upper edge of one of the two side walls comprising one of the pair of side walls of said dock frame and a second deck flange located on an upper edge of the other of the two side walls comprising said pair of side walls of said dock frame, wherein each deck flange is substantially planar, is oriented substantially parallel to the floor of said dock frame, and extends partially over the interior space of said dock frame, such that the deck flanges provide support for decking placed thereon and attached thereto.

4. The dock float system of claim 1 wherein the dock frame of each of the one or more dock float components further comprises a central beam, said central beam being located within the interior space of said dock frame and being adjacent to the floor of said dock frame, said central beam rising upward from said floor in a substantially perpendicular orientation to said floor, with said central beam running between and being adjacent to each of the side walls comprising the second pair of side walls of said dock frame and oriented substantially perpendicular to said side walls comprising the second pair of side walls, said central beam being spaced apart from the two side walls comprising the first pair of side walls and being oriented substantially parallel to said side walls comprising the first pair of side walls;

wherein said central beam is comprised of two substantially rectangular side walls spaced apart from each other and forming a hollow void therebetween, whereby said hollow void is at least partially filled with concrete.

5. The dock float system of claim 4 wherein said side walls of said central beam are oriented substantially parallel to each other.

6. The dock float system of claim 4 wherein said side walls of said central beam are angled slightly towards each other, such that portions of said side walls adjacent to said floor of said dock frame are farther apart from each other than portions of said side walls furthest from said floor.

7. The dock float system of claim 4 wherein horizontally oriented reinforcement components are placed in the concrete that is located within the hollow void of the central beam.

8. The dock float system of claim 4 wherein said central beam further comprises a reinforced composite cap, said cap placed onto top edges of the side walls of said central beam, thereby sealing the hollow void of said central beam.

9. The dock float system of claim 4 wherein the dock frame of each of the one or more dock float components further comprises one or more cross beams, with each said cross beam being located within the interior space of said dock frame and being adjacent to the floor of said dock frame, each said cross beam rising upward from said floor in a substantially perpendicular orientation to said floor, with each said cross beam running between and being adjacent to the central beam and one side wall of said dock frame and oriented substantially perpendicular to said side wall and said central beam;

wherein each said cross beam is comprised of two substantially rectangular side walls spaced apart from each other and forming a hollow void therebetween, whereby said hollow void is at least partially filled with concrete.

10. The dock float system of claim 9 wherein said side walls of each said cross beam are oriented substantially parallel to each other.

11. The dock float system of claim 9 wherein said side walls of each said cross beam are angled slightly towards each other, such that portions of said side walls adjacent to said floor of said dock frame are farther apart from each other than portions of said side walls furthest from said floor.

12. The dock float system of claim 9 wherein horizontally oriented reinforcement components are placed in the concrete that is located within the hollow void of each of the cross beams.

13. The dock float system of claim 9 wherein each said cross beam further comprises a reinforced composite cap, said cap placed onto top edges of the side walls of said cross beam, thereby sealing the hollow void of said cross beam.

14. A dock float system, said system comprising one or more dock float components, each said dock float component comprised of a dock frame and one or more floats, with each of the one or more floats affixed to an underside of said dock frame;

wherein said dock frame is constructed of fiberglass reinforced plastic and incorporates concrete therein, each of the one or more floats of the one or more dock float components is constructed of fiberglass reinforced plastic and incorporates concrete therein, and each of the one or more floats of each of the one or more dock float components is a substantially rectangular structure having four substantially rectangular side walls and a substantially rectangular floor, enclosing an interior space, wherein two of the side walls comprising a first pair of side walls are oriented substantially parallel to each other, and two other side walls comprising a second pair of side walls are oriented substantially parallel to each other, with each side wall of the first pair of side walls adjacent to both side walls of the second pair of side walls, with adjacent side walls oriented substantially perpendicular to each other, and all four side walls adjacent to and oriented substantially perpendicular to the floor, such that the four side walls and the floor are formed as a monolithic unit, with water tight seams at all points of adjacency of the side walls and floor;

whereby said interior space of each said float is at least partially filled with a quantity of concrete, such that the quantity of concrete located within each float is substantially the same as the quantity of concrete located within each other float, and said dock float system is placed into a water environment such that said dock float system floats with the dock frame being substantially above the water and the one or more floats being substantially submerged.

15. A dock float system, said system comprising one or more dock float components, each said dock float component comprised of a dock frame and one or more floats, with each of the one or more floats affixed to an underside of said dock frame;

wherein said dock frame is constructed of fiberglass reinforced plastic and incorporates concrete therein, each of the one or more floats of each of the one or more dock float components is constructed of fiberglass reinforced plastic and incorporates concrete therein, and each of the one or more floats of each of the one or more dock float components is a structure having four side walls and a substantially rectangular floor, enclosing an interior space, wherein two of the side walls are substantially trapezoidal in shape and two of the sidewalls are substantially rectangular, with the two substantially trapezoidal side walls comprising a first pair of side walls which are oriented substantially parallel to each other, and with the two substantially rectangular side walls comprising a second pair of side walls which are angled towards each other and adjacent to the side walls of the first pair of side walls, with all four side walls adjacent to the floor, such that the four side walls and the floor are formed as a monolithic unit, with water tight seams at all points of adjacency of the side walls and floor;

whereby said interior space of each said float is at least partially filled with a quantity of concrete, such that the quantity of concrete located within each float is substantially the same as the quantity of concrete located within each other float, and said dock float system is placed into a water environment such that said dock float system floats with the dock frame being substantially above the water and the one or more floats being substantially submerged.

16. A dock float system, said system comprising one or more dock float components, each said dock float component comprised of a dock frame and one or more floats, with each of the one or more floats affixed to an underside of said dock frame;

wherein said dock frame is constructed of fiberglass reinforced plastic and incorporates concrete therein, each of the one or more floats of each of the one or more dock float components is constructed of fiberglass reinforced plastic and incorporates concrete therein, and each of the one or more floats of each of the one or more dock float components is a structure having four substantially trapezoidal side walls and a substantially rectangular floor, enclosing an interior space, wherein two of the side walls comprise a first pair of side walls and the other two of side walls comprise a second pair of side walls, with the first pair of side walls angled towards each other and the second pair of side walls angled towards each other, with each side wall of the first pair of side walls adjacent to the side walls of the second pair of side walls, with all four side walls adjacent to the floor, such that the four side walls and the floor are formed as a monolithic unit, with water tight seams at all points of adjacency of the side walls and floor;

whereby said interior space of each said float is at least partially filled with a quantity of concrete, such that the quantity of concrete located within each float is substantially the same as the quantity of concrete located within each other float, and said dock float system is placed into a water environment such that said dock float system floats with the dock frame being substantially above the water and the one or more floats being substantially submerged.

17. The dock float system of claim 1 wherein each of the one or more dock float components has four floats attached thereto.

18. The dock float system of claim 1 wherein said system comprises a plurality of dock float components, with each of the plurality of dock float components being attached to at least one other of the plurality of dock float components, with each of the plurality of dock float components being attached to at least one other of the plurality of dock float components by one or more elongate connectors, and each of the one or more elongate connectors has a first end and a second end, and the first end of each of the one or more elongate connectors is attached to an outer surface of one of the side walls of the dock frame of one of the plurality of dock float components.

19. The dock float system of claim 18 wherein the second end of at least one of the one or more elongate connectors is attached to an outer surface of one of the side walls of the dock frame of one of the plurality of dock float components other than the dock float component to which the first end of said elongate connector is attached.

20. The dock float system of claim 18 wherein the second end of at least one of the one or more elongate connectors is attached to the second end of another of the one or more elongate components.

* * * * *